US005405077A

United States Patent [19]

Damon

[11] Patent Number: 5,405,077

[45] Date of Patent: Apr. 11, 1995

[54] REVOLVING NEWSPAPER ORGANIZER

[76] Inventor: Barron J. Damon, 1401 Longcreek Dr. Apt. 104-A, Columbia, S.C. 29210

[21] Appl. No.: 231,920

[22] Filed: Apr. 25, 1994

[51] Int. Cl.[6] ..... B65D 91/00

[52] U.S. Cl. ..... 232/1 C; 232/24; 312/249.2; 206/425

[58] Field of Search ..... 232/1 C, 38, 39, 17, 232/24, 41 C; 312/97.1, 249.2; 206/425

[56] References Cited

U.S. PATENT DOCUMENTS

| | | | |
|---|---|---|---|
| 233,992 | 11/1880 | Crowder et al. | 232/39 |
| 566,135 | 8/1896 | Burns | 232/41 C |
| 717,713 | 1/1903 | Perkins | 312/249.2 |
| 984,835 | 2/1911 | Meeks | 312/97.1 |
| 1,076,421 | 10/1913 | Hale | 312/97.1 |
| 1,286,675 | 12/1918 | Lissmann | 312/97.1 |
| 1,478,590 | 12/1923 | Tamborello | 232/41 C |
| 1,642,806 | 9/1927 | Choate | 232/39 |

*Primary Examiner*—Michael J. Milano

[57] ABSTRACT

A revolving newspaper organizer comprised of a hollow cylindrical container having a surrounding side wall. The surrounding side wall has an interior surface and an exterior surface. The surrounding side wall has a top edge and a bottom edge. The surrounding side wall has a rectangular opening formed therein. The hollow cylindrical container has a circular base. The circular base has a top side and a bottom side. An intermediate base is secured to the interior surface of the hollow cylindrical container. An aperture is formed through the intermediate base. An axle has a first end and a second end. The first end is secured through the aperture of the intermediate base. A circular top has a bottom side and a top side. A plurality of openings are through the bottom side and the top side. The bottom side is securely fastened to the second end of the axle. The bottom side has a circular recess in alignment with the top edge of the hollow cylindrical container. The circular recess functions to allow the circular top to rotate on the axle. A plurality of receptacles with open top ends and closed bottom ends. The open top ends are secured within the openings of the circular top. The receptacles function to hold newspapers.

5 Claims, 4 Drawing Sheets

REVOLVING NEWSPAPER ORGANIZER

BACKGROUND OF THE INVENTION

1. Field of the Invention

The present invention relates to a revolving newspaper organizer and more particularly pertains to storing newspapers for easy retrieval.

2. Description of the Prior Art

The use of newspaper holders is known in the prior art. More specifically, newspaper holders heretofore devised and utilized for the purpose of storing newspapers are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,114,020 to Martin a container for collecting and storing newspapers, magazines, and other articles.

U.S. Pat. No. 4,901,912 to Pinard discloses a newspaper container. A tubular container having a flat back face adapted to rest against a door surrounded by a door jamb.

U.S. Pat. No. 5,167,329 to Wilhite discloses a foldable rack for storing newspapers and magazines in a vertical stack.

U.S. Pat. No. Des. 251,708 to Robinson discloses the design of a wall mounted newspaper holder.

U.S. Pat. No. Des. 264,032 to Rule discloses the design of a combined newspaper and book holder.

In this respect, the revolving newspaper organizer according to the present invention substantially departs from the conventional concepts and designs of the prior art, and in doing so provides an apparatus primarily developed for the purpose of storing newspapers for easy retrieval.

Therefore, it can be appreciated that there exists a continuing need for a new and improved revolving newspaper organizer which can be used for storing newspapers for easy retrieval. In this regard, the present invention substantially fulfills this need.

SUMMARY OF THE INVENTION

In view of the foregoing disadvantages inherent in the known types of newspaper holders now present in the prior art, the present invention provides an improved revolving newspaper organizer. As such, the general purpose of the present invention, which will be described subsequently in greater detail, is to provide a new and improved revolving newspaper organizer and method which has all the advantages of the prior art and none of the disadvantages.

To attain this, the present invention essentially comprises a revolving newspaper organizer comprised of a hollow cylindrical container having a surrounding side wall. The surrounding side wall has an interior surface and an exterior surface. The surrounding side wall has a top edge and a bottom edge. The surrounding side wall has a rectangular opening formed therein. The hollow cylindrical container has a circular base. The circular base has a top side and a bottom side. An intermediate base is secured to the interior surface of the hollow cylindrical container. An aperture is formed through the intermediate base. An axle having a first end and a second end. The first end is secured through the aperture of the intermediate base. A circular top has a bottom side and a top side. A plurality of openings are through the bottom side and the top side. The bottom side is securely fastened to the second end of the axle. The bottom side has a circular recess in alignment with the top edge of the hollow cylindrical container. The circular recess functions to allow the circular top to rotate on the axle. A plurality of receptacles have open top ends and closed bottom ends. The open top ends are secured within the openings of the circular top. The receptacles function to hold newspapers. A plurality of short legs are secured to the bottom side of the circular base. A support ledge is secured to the interior surface of the hollow cylindrical container. The support ledge is positioned below the rectangular opening thereof. A removable rectangular drawer has a grasping means. The removable rectangular drawer slides on the support ledge. The removable rectangular drawer enters through the rectangular opening Of the hollow cylindrical container.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved revolving newspaper organizer which has all the advantages of the prior art newspaper holders and none of the disadvantages.

It is another object of the present invention to provide a new and improved revolving newspaper organizer which may be easily and efficiently manufactured and marketed.

It is further object of the present invention to provide a new and improved revolving newspaper organizer which is of durable and reliable constructions.

An even further object of the present invention is to provide a new and improved revolving newspaper organizer which is susceptible of a low cost of manufacture with regard to both materials and labor, and which accordingly is then susceptible of low prices of sale to the consuming public, thereby making such a revolving newspaper organizer economically available to the buying public.

Still yet another object of the present invention is to provide a new and improved revolving newspaper organizer which provides in the apparatuses and methods of the prior art some of the advantages thereof, while simultaneously overcoming some of the disadvantages normally associated therewith.

Even still another object of the present invention is to store newspapers for easy retrieval.

Lastly, it is an object of the present invention to provide a new and improved revolving newspaper organizer comprised of a hollow cylindrical container having a surrounding side wall. The surrounding side wall has an interior surface and an exterior surface. The surrounding side wall has a top edge and a bottom edge. The surrounding side wall has a rectangular opening formed therein. The hollow cylindrical container has a circular base. The circular base has a top side and a bottom side. An intermediate base is secured to the interior surface of the hollow cylindrical container. An aperture is formed through the intermediate base. An axle having a first end and a second end. The first end is secured through the aperture of the intermediate base. A circular top has a bottom side and a top side. A plurality of openings are through the bottom side and the top side. The bottom side is securely fastened to the second end of the axle. The bottom side has a circular recess in alignment with the top edge of the hollow cylindrical container. The circular recess functions to allow the circular top to rotate on the axle. A plurality of receptacles have open top ends and closed bottom ends. The open top ends are secured within the openings of the circular top. The receptacles function to hold newspapers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
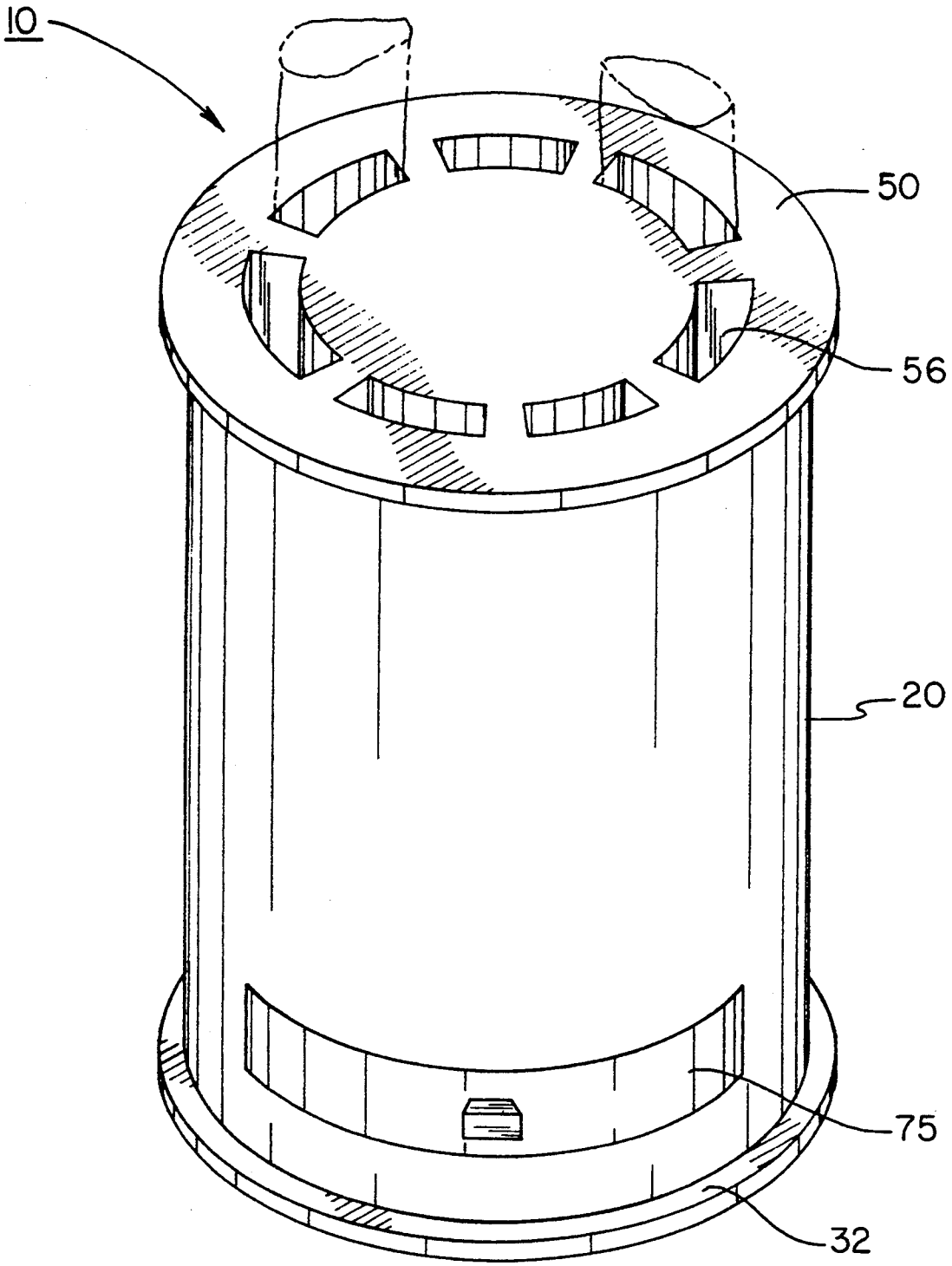
FIG. 1 is a perspective view of the revolving newspaper organizer constructed in accordance with the principles of the present invention.
Figure 2:
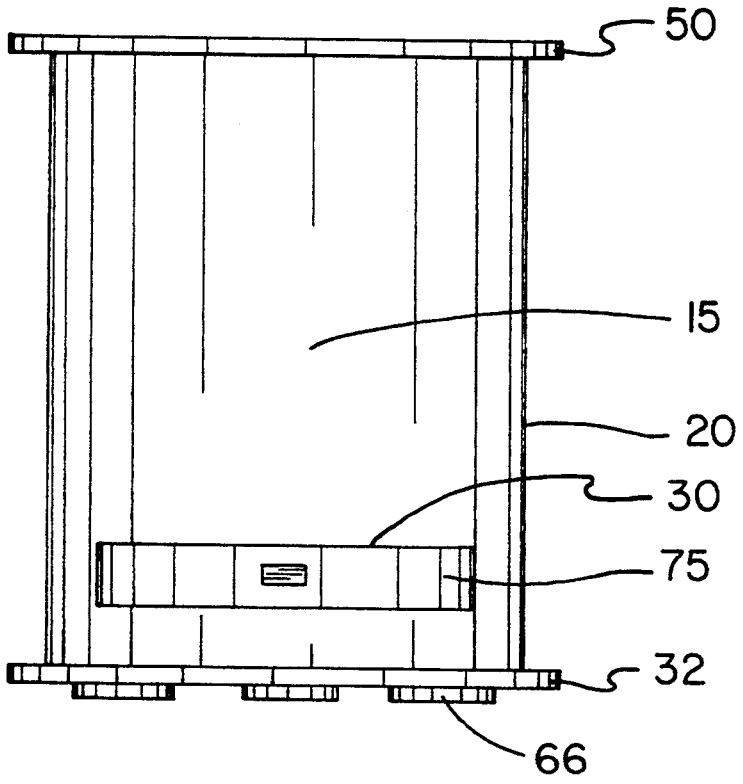
FIG. 2 is a side view of the present invention in accordance with the principles of the present invention.
Figure 3:
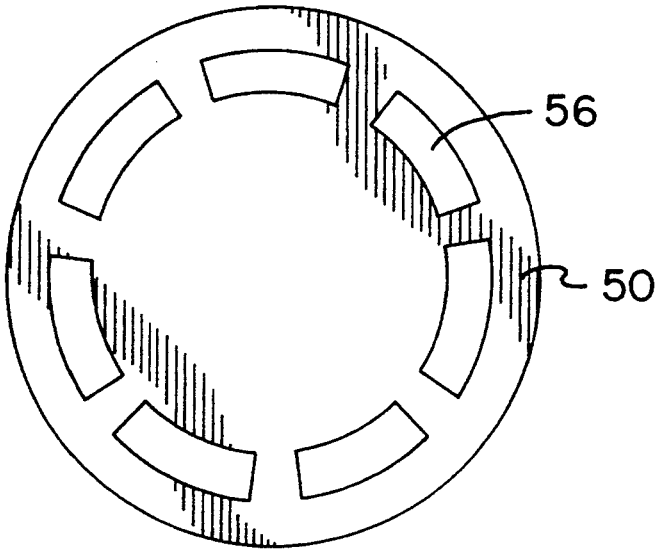
FIG. 3 is a top view of the present invention in accordance with the principles of the present invention.
Figure 4:
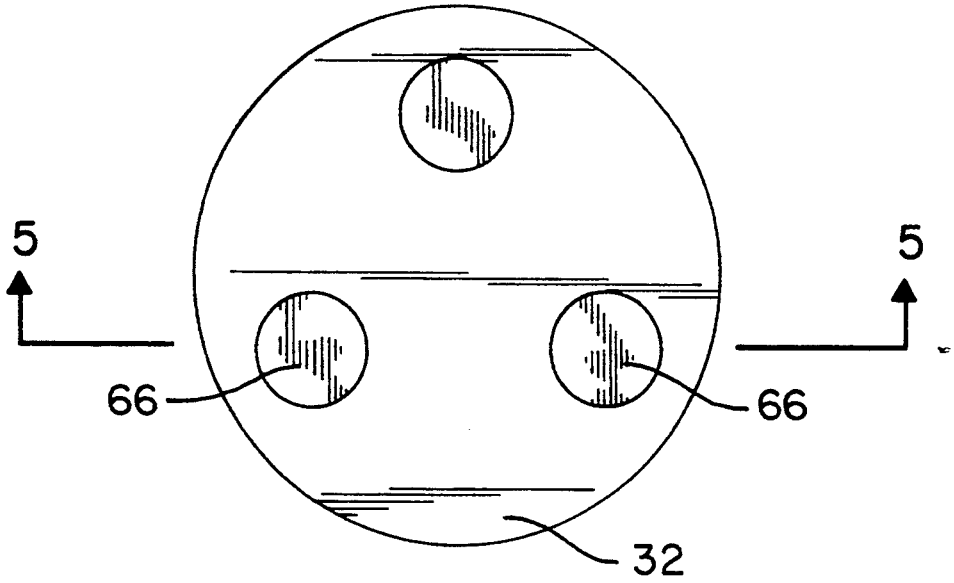
FIG. 4 is a bottom view of the present invention in accordance with the principles of the present invention.
Figure 5:
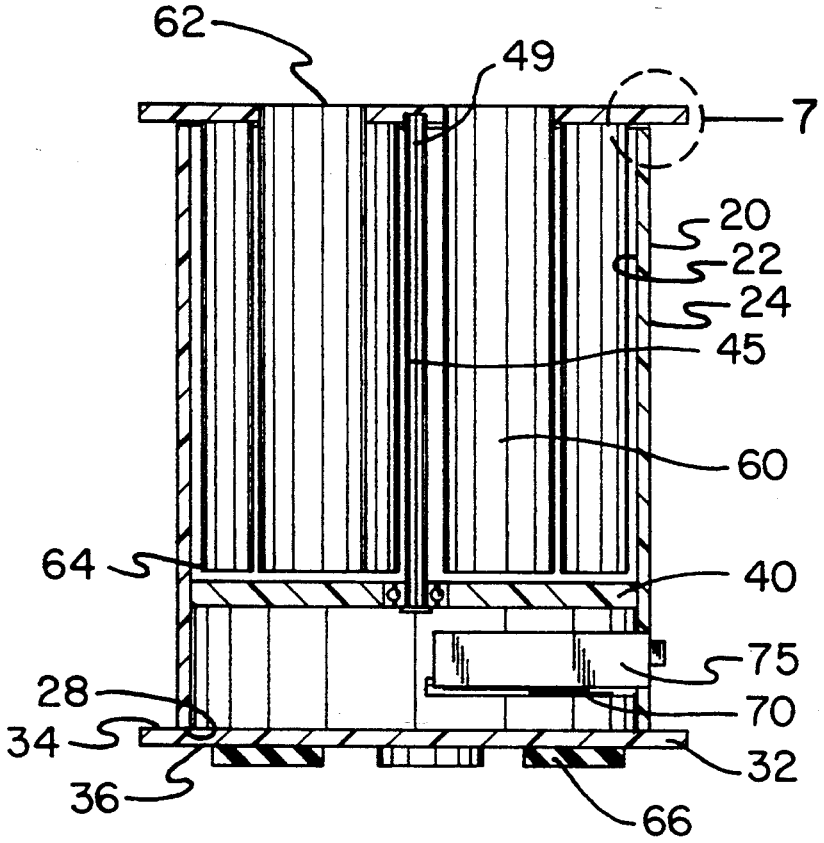
FIG. 5 is a side sectional view of the present invention and is a view taken along line 5—5 of FIG. 4.
Figure 6:
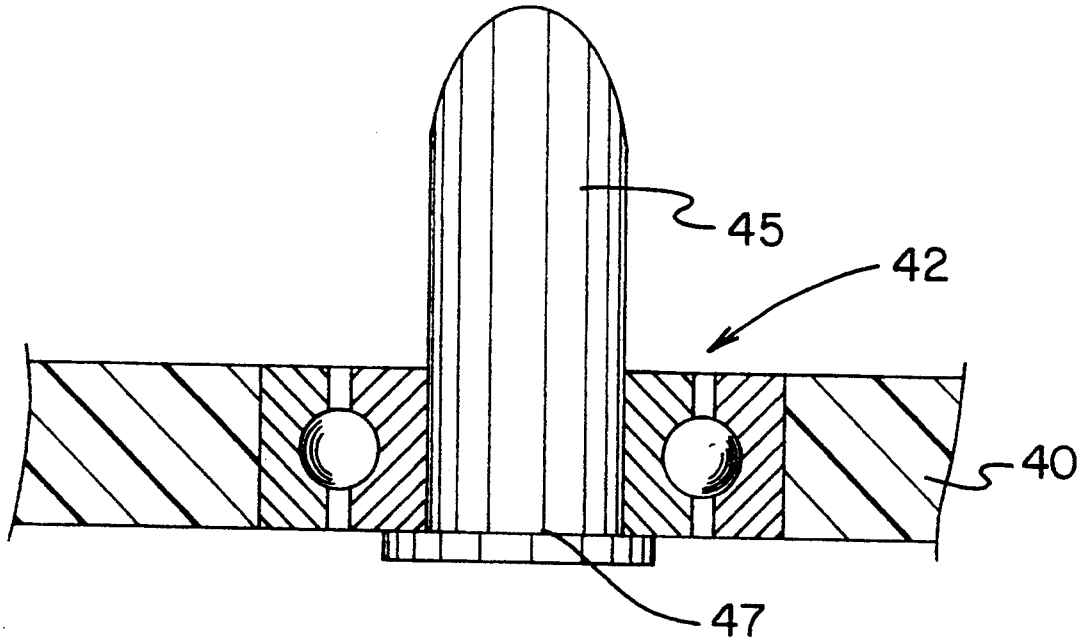
FIG. 6 is a view of the axle in accordance with the present invention.
Figure 7:
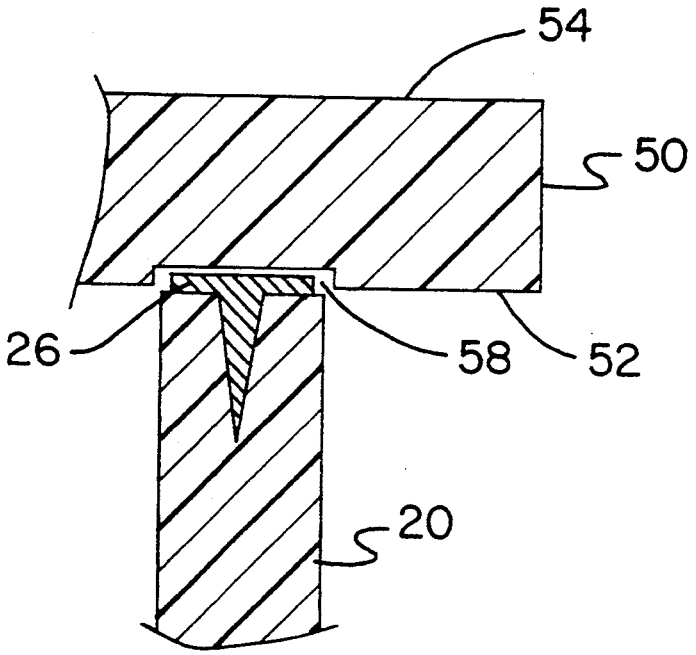
FIG. 7 is a view taken along circle 7 of FIG. 5 in accordance with the principles of the present invention.

With reference now to the drawings, and in particular to FIG. 1 thereof, the preferred embodiment of the new and improved revolving newspaper organizer embodying the principles and concepts of the present invention and generally designated by the reference numeral 10 will be described.

More specifically, it will be noted in the various Figures that the present invention relates to a device 10 for storing one's daily newspapers for easy retrieval. It is especially convenient for the person who does not have the opportunity to read the daily newspaper completely on the day it is published. In its broadest context the device 10 includes a hollow cylindrical container 15, an intermediate base 40, an axle 45, a circular top 50, a plurality of receptacles 60, a plurality of short legs 66, a support ledge 70, and a removable rectangular drawer 75.

The hollow cylindrical container 15 has a surrounding side wall 20. The surrounding side wall 20 has an interior surface 22 and an exterior surface 24. The surrounding side wall 20 has a top edge 26 and a bottom edge 28. The surrounding side wall 20 has a rectangular opening 30 formed therein. The hollow cylindrical container 15 has a circular base 32. The circular base 32 has a top side 34 and a bottom side 36.

An intermediate base 40 is secured to the interior surface 22 of the hollow cylindrical container 15. An aperture 42 is formed through the intermediate base 40. The axle 45 has a first end 47 and a second end 49. The first end 47 is secured through the aperture 42 of the intermediate base 40. A circular top 50 has a bottom side 52 and a top side 54. There are a plurality of openings 56 through the bottom side 52 and the top side 54. The bottom side 52 is securely fastened to the second end 49 of the axle 45. The bottom side 52 has a circular recess 58 in alignment with the top edge 26 of the hollow cylindrical container 15. The circular recess 58 functions to allow the circular top 50 to rotate on the axle 45.

The plurality of receptacles 60 have open top ends 62 and closed bottom ends 64. The open top ends 62 are secured within the openings 56 of the circular top 50. The receptacles 60 function to hold newspapers. The plurality of short legs 66 are secured to the bottom side 36 of the circular base 32. The support ledge 70 is secured to the interior surface 22 of the hollow cylindrical container 15. The support ledge 70 is positioned below the rectangular opening 30 thereof. The removable rectangular drawer 75 has a grasping means. The removable rectangular drawer 75 slides on the support ledge 70. The removable rectangular drawer 75 enters through the rectangular opening 30 of the hollow cylindrical container 15.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved revolving newspaper organizer comprising, in combination:

a hollow cylindrical container having a surrounding side wall, the surrounding side wall having an interior surface and an exterior surface, the surrounding side wall having a top edge and a bottom edge, the surrounding side wall having a rectangular opening formed therein, the hollow cylindrical container having a circular base, the circular base having a top side and a bottom side;

an intermediate base secured to the interior surface of the hollow cylindrical container, an aperture formed through the intermediate base;

an axle having a first end and a second end, the first end secured through the aperture of the intermediate base;

a circular top having a bottom side and a top side, a plurality of openings through the bottom side and the top side, the bottom side securely fastened to the second end of the axle, the bottom side having a circular recess in alignment with the top edge of the hollow cylindrical container, the circular recess functioning to allow the circular top to rotate on the axle;

a plurality of receptacles having open top ends and closed bottom ends, the open top ends secured within the openings of the circular top, the receptacles functioning to hold newspapers;

a plurality of short legs secured to the bottom side of the circular base;

a support ledge secured to the interior surface of the hollow cylindrical container, the support ledge positioned below the rectangular opening thereof; and a removable rectangular drawer having a grasping means, the removable rectangular drawer sliding on the support ledge, the removable rectangular drawer entering through the rectangular opening of the hollow cylindrical container.

2. A revolving newspaper organizer comprising:

a hollow cylindrical container having a surrounding side wall, the surrounding side wall having an interior surface and an exterior surface, the surrounding side wall having a top edge and a bottom edge, the surrounding side wall having a rectangular opening formed therein, the hollow cylindrical container having a circular base, the circular base having a top side and a bottom side;

an intermediate base secured to the interior surface of the hollow cylindrical container, an aperture formed through the intermediate base;

an axle having a first end and a second end, the first end secured through the aperture of the intermediate base;

a circular top having a bottom side and a top side, a plurality of openings through the bottom side and the top side, the bottom side securely fastened to the second end of the axle, the bottom side having a circular recess in alignment with the top edge of the hollow cylindrical container, the circular recess functioning to allow the circular top to rotate on the axle;

a plurality of receptacles having open top ends and closed bottom ends, the open top ends secured within the openings of the circular top, the receptacles functioning to hold newspapers.

3. The organizer as described in claim 2 and further comprising:

a plurality of short legs secured to the bottom side of the circular base.

4. The organizer as described in claim 3 and further comprising:

a support ledge secured to the interior surface of the hollow cylindrical container, the support ledge positioned below the rectangular opening thereof.

5. The organizer as described in claim 4 and further comprising:

a removable rectangular drawer having a grasping means, the removable rectangular drawer sliding on the support ledge, the removable rectangular drawer entering through the rectangular opening of the hollow cylindrical container.

* * * * *